United States Patent [19]

Ohm

[11] Patent Number: 4,535,338

[45] Date of Patent: Aug. 13, 1985

[54] MULTIBEAM ANTENNA ARRANGEMENT

[75] Inventor: Edward A. Ohm, Holmdel, N.J.

[73] Assignee: AT&T Bell Laboratories, Murray Hill, N.J.

[21] Appl. No.: 376,604

[22] Filed: May 10, 1982

[51] Int. Cl.[3] ..... H01Q 15/16; H01Q 19/19

[52] U.S. Cl. ..... 343/781 CA; 343/837

[58] Field of Search ..... 343/781 CA, 781 P, 781 R, 343/DIG. 2, 835–839, 779, 914, 840, 761

[56] References Cited

U.S. PATENT DOCUMENTS

| | | | |
|---|---|---|---|
| 3,146,451 | 8/1964 | Sternberg | 343/753 |
| 3,406,401 | 10/1968 | Tillotson | 343/835 |
| 3,641,577 | 2/1972 | Tocquec | 343/781 CA |
| 3,680,141 | 6/1972 | Karikomi | 343/758 |
| 3,688,311 | 8/1972 | Salmon | 343/755 |
| 3,737,909 | 6/1973 | Bartlett et al. | 343/755 |
| 3,792,480 | 2/1974 | Graham | 343/781 |
| 3,821,746 | 6/1974 | Mizusawa et al. | 343/781 |
| 3,828,352 | 8/1974 | Drabowitch et al. | 343/837 |
| 3,922,682 | 11/1975 | Hyde | 343/761 |
| 3,995,275 | 11/1976 | Betsudan et al. | 343/914 |
| 4,145,695 | 3/1979 | Gans | 343/779 |
| 4,203,105 | 5/1980 | Dragone et al. | 343/781 |
| 4,236,161 | 11/1980 | Ohm | 343/781 CA |
| 4,339,757 | 7/1982 | Chu | 343/781 CA |
| 4,360,815 | 11/1982 | Mizuguchi et al. | 343/781 P |

OTHER PUBLICATIONS

Mittra et al., "A Method for Synthesizing Offset, Dual Reflector Antennas," AP-S International Symposium, College Park, Md., May 1978, pp. 239–242.

Donn; "Shapings of Dual Reflector Antenna Systems," AP-S International Symposium, Seattle, Wa., 1979, pp. 80–83.

Chu; "Broadband Astigmatic Compensation," AP-S International Symposium, Los Angeles, Ca., 1981, pp. 131–134.

Jenkins et al., "Fundamentals of Optics," McGraw-Hill, N.Y., 1957, pp. 152–153.

*Primary Examiner*—Eli Lieberman

*Assistant Examiner*—Michael C. Wimer

*Attorney, Agent, or Firm*—Erwin W. Pfeifle

[57] ABSTRACT

The present invention relates to a multibeam antenna arrangement comprising a main focusing reflector, a doubly curved subreflector disposed confocally with the main reflector and a plurality of feeds disposed on a doubly curved focal surface of the antenna on which an image of the far field of view is formed. The subreflector is doubly curved in orthogonal directions to introduce a predetermined amount of barrel distortion for transforming a three-dimensional, non-rectangular, matrix in the far field of the antenna arrangement into a substantially rectangular matrix on the doubly curved focal surface of the antenna arrangement. Feeds are aimed such that a central ray from each feed reflected by the subreflector impinges a common point on the main reflector. Beams of a satellite antenna introducing barrel distortion can be re-aimed toward a given set of earth coordinates when a satellite is moved in equatorial orbit by rotating the subreflector about an axis, which is substantially parallel to the axis of the earth, and which passes through the confocal point of the antenna.

5 Claims, 7 Drawing Figures

MULTIBEAM ANTENNA ARRANGEMENT

BACKGROUND OF THE INVENTION

1. Field of the Invention

The present invention relates to a multibeam antenna arrangement comprising two or more reflecting surfaces and, more particularly, to a Cassegrainian antenna comprising a main reflector, a doubly curved subreflector, and a doubly curved focal surface on which feeds are appropriately disposed. Subreflector parameters are chosen such that a predetermined amount of distortion is introduced which transforms a three-dimensional, non-rectangular, matrix as might be seen in the far field of the antenna as, for example, an actual view of latitudinal and longitudinal lines of earth as seen from equatorial orbit into a substantially rectangular matrix on a doubly curved focal surface of the antenna.

2. Description of the Prior Art

Except for possibly the boresight beam of an antenna, an antenna beam generally will suffer from some sort of aberration if its feedhorn is located away from the geometrical focus so that a radiated planar wavefront is not produced. This is particularly true in a multibeam antenna. However, antennas have been previously devised to correct for certain aberrations which have been found to exist.

U.S. Pat. No. 3,146,451 issued to R. L. Sternberg on Aug. 25, 1964 relates to a microwave dielectric lens for focusing microwave energy emanating from a plurality of off-axis focal points into respective collimated beams angularly oriented relative to the lens axis. In this regard also see U.S. Pat. No. 3,737,909 issued to H. E. Bartlett et al on June 5, 1973.

Other antenna system arrangements are known which use subreflectors and the positioning of feedhorns to compensate for some aberrations normally produced by such antenna systems. In this regard see, for instance U.S. Pat. Nos. 3,688,311 issued to J. Salmon on Aug. 29, 1972; 3,792,480 issued to R. Graham on Feb. 12, 1974; and 3,821,746 issued to M. Mizusawa et al on June 28, 1974.

U.S. Pat. No. 3,828,352 issued to S. Drabowitch et al on Aug. 6, 1974 relates to microwave antennas including a toroidal reflector designed to reduce spherical aberration. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975 relates to an aberration correcting subreflector for a toroidal reflector antenna. More particularly, an aberration correcting subreflector has a specific shape which depends on the specific geometry of the main toroidal reflector. The actual design is achieved by computing points for the surface of the subreflector such that all rays focus at a single point and that all pathlengths from a reference plane to the point of focus are constant and equal to a desired reference pathlength. The Hyde subreflector, however, (a) only corrects for on-axis aberration of the torus (similar to spherical aberration), (b) only compensates for aberrations when positioned in the far field of the feed, and (c) can be used to produce offset beams in only one plane.

It was found that the dominant aberration introduced in an off-axis beam from a dual reflector or Cassegrainian antennas is astigmatism, which aberration was corrected by the arrangement disclosed in U.S. Pat. No. 4,145,695 issued to M. J. Gans on Mar. 20, 1979, and discussed in the article "Broadband Astigmatic Compensation" by T. Chu in AP-S International Symposium, 1981, Vol. 1, Los Angeles, California, at pp. 131–134.

Although the above-described techniques have compensated for some aberrations found in antennas, none have compensated for, or introduced, for example, barrel distortion for converting, for example, an actual view of the curved latitudinal and longitudinal lines of a celestial body as seen in the far field of a satellite antenna in orbit around the celestial body into a substantially rectangular matrix on the focal surface of the antenna. Therefore, a problem remaining in the prior art is to provide an antenna arrangement which compensates for or introduces a predetermined amount of distortion as, for example, barrel distortion.

SUMMARY OF THE INVENTION

The foregoing problem has been solved in accordance with the present invention which relates to a multibeam antenna arrangement comprising two or more reflecting surfaces and, more particularly, to a Cassegrainian antenna comprising a doubly curved subreflector, and a doubly curved focal surface on which feeds are appropriately disposed. Subreflector parameters are chosen such that a predetermined amount of distortion is introduced for transforming a three-dimensional, non-rectangular, matrix as seen in the far field of the antenna into a substantially rectangular matrix at a doubly curved focal surface of the antenna.

It is an aspect of the present invention to provide an antenna arrangement for a satellite which permits easy reconfiguration of its multiple beams to their original ground area locations in the far field of the antenna by merely rotating a doubly-curved subreflector by a predetermined amount rather than physically repositioning each feed on the focal surface or electronically reconfiguring the beams; the axis of rotation being substantially parallel to the axis of the earth and passes through the focus of the main reflector.

The foregoing aspects have been achieved by an antenna arrangement which introduces a predetermined amount of distortion using a doubly curved subreflector with all feeds being disposed on a doubly curved focal surface of the antenna and aimed such that the central ray of each beam launched by each of the feeds impinges a common point on the main reflector. In this manner a three-dimensional, non-rectangular, matrix in the far field of the antenna as, for example, the longitudinal and latitudinal lines of a celestial body as seen from a satellite antenna in orbit about the celestial body are converted to a substantially rectangular matrix on the focal surface of the antenna. With such antenna, when a satellite is repositioned to a new equatorial orbit location above a celestial body, the subreflector need only be rotated by a predetermined amount to realign all beams to their proper ground area locations; the axis of rotation being substantially parallel to the axis of the celestial body and passes through the focus of the main reflector.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention is described hereinafter in the exemplary form of an offset Cassegrainian antenna to illustrate the advantage that when such antenna is used on a satellite in equatorial orbit about a celestial body and such satellite is subsequently repositioned in equatorial orbit, the antenna can be reconfigured to properly aim its beams to their original ground area locations in the far field of the antenna by merely rotating the subreflector of the antenna by a predetermined amount. The axis of subreflector rotation to achieve such repositioning is substantially parallel to the axis of the celestial body and passes through the focus of the main reflector. Such arrangement avoids the more difficult and possibly impractical techniques of physically repositioning the feeds on the focal surface of the antenna or electronically reconfiguring the beams by switching to adjacent feeds when a satellite is repositioned in orbit.

Figure 1:
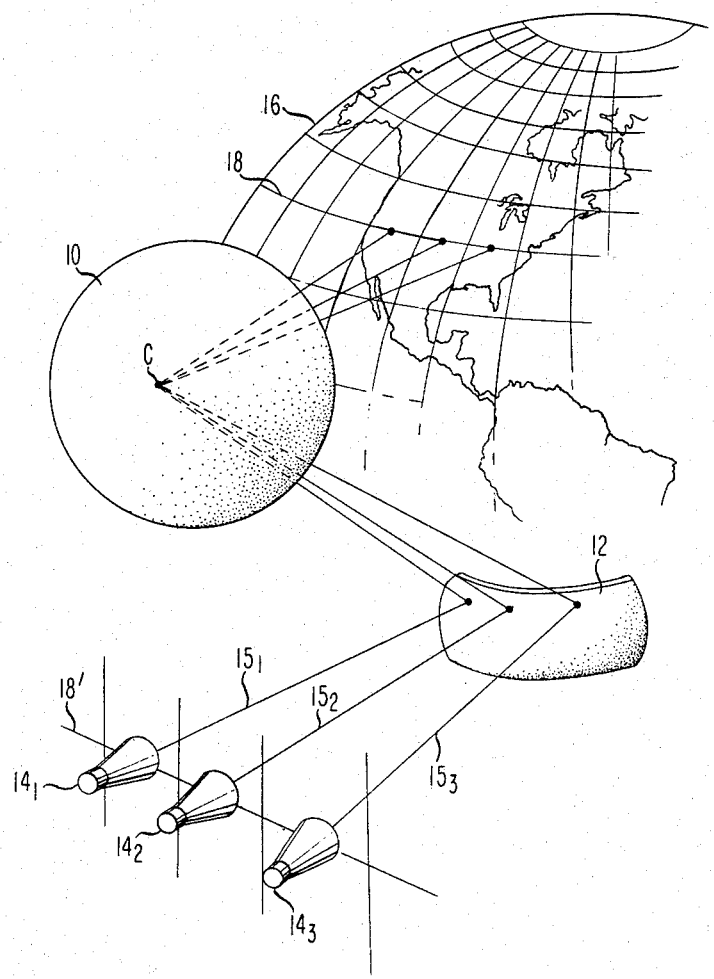
FIG. 1 is a view in perspective of an antenna arrangement in accordance with the present invention which is disposed in equatorial orbit above a celestial body.

FIG. 1 illustrates the general concept of the present invention as applied to a satellite antenna. In accordance with the present invention, the antenna comprises a main parabolic reflector 10, a doubly curved subreflector 12 disposed confocally with main reflector 10, and a plurality of exemplary feeds $\mathbf{14}_1$–$\mathbf{14}_3$ disposed on a doubly curved focal surface of the overall antenna arrangement. It is to be understood that the term "doubly curved" used herein is meant to include any substantially spherically curved surface formed from the same or different curvature in orthogonal directions on the focal surface. As generally shown in FIG. 1, when an antenna is placed in orbit on a satellite on the equatorial arc, the far field of view, when directed at the celestial body 16, effectively sees the imaginary latitudinal and longitudinal lines on such celestial body as curved matrix lines with reduced spacings as such lines are more distant from the subsatellite point on the celestial body. An image of the far field of the antenna produced at the focal suface of a prior art antenna would correspond to the actual view of such lines as seen by the antenna and, therefore, would require spot beam feeds to be disposed closer together when their beams are aimed, for example, at adjacent longitudinal lines in the higher latitude areas than found with feeds similarly aimed at those longitudinal lines closer to the equator.

In accordance with the present invention, a doubly curved subreflector 12 is included in the present antenna having a reflecting surface configuration which transforms a three-dimensional spherical coordinate system in the far field of view into effectively a substantial rectangular coordinate system on the doubly curved focal surface of the antenna. Additionally, as shown in FIG. 1, the latitude line 18 on celestial body 16 is depicted on the focal surface of the present antenna as image line 18'. Exemplary feeds $\mathbf{14}_1$–$\mathbf{14}_3$ are also shown disposed on image line 18' and aimed such that central rays $\mathbf{15}_1$–$\mathbf{15}_3$ of beams launched by feeds $\mathbf{14}_1$–$\mathbf{14}_3$, respectively, impinge on common point C on the reflecting surface of main parabolic reflector 10 before being directed to the associated area on latitude line 18.

Figure 2:
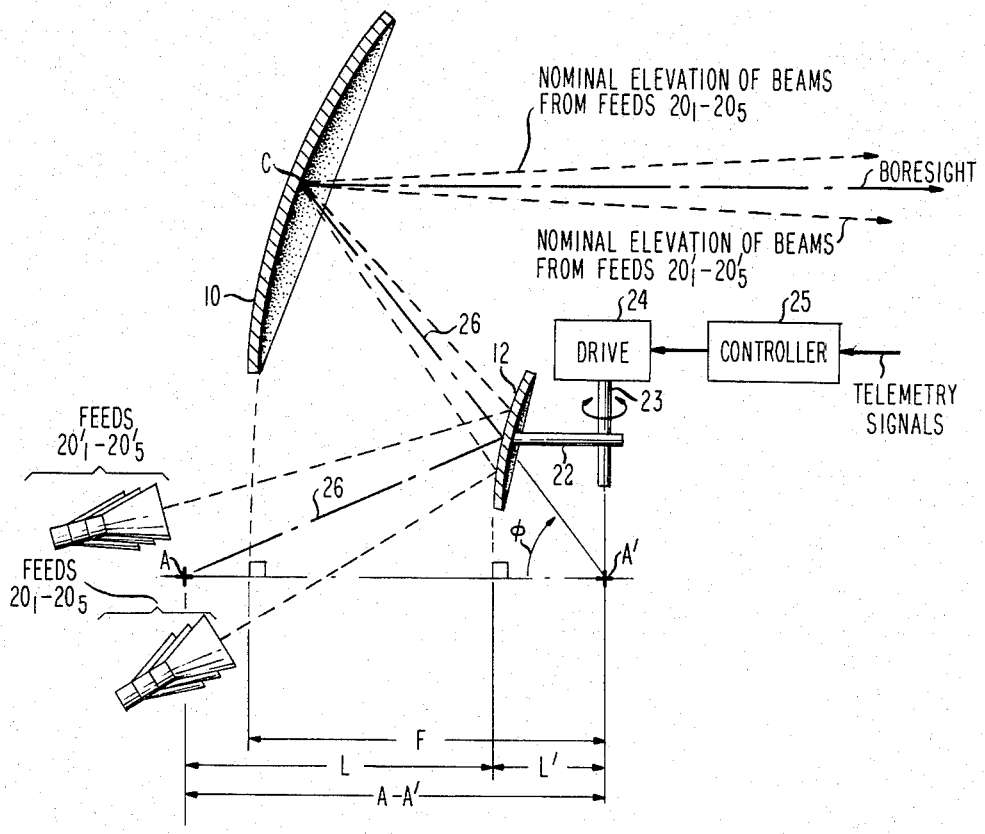
FIG. 2 is a side view in cross-section of an antenna arrangement in accordance with the present invention.

FIGS. 2–7 illustrate the structure and functioning of the antenna in accordance with the present invention in greater detail. FIG. 2 illustrates a side view of the arrangement of the present Cassegrainian antenna offset by an angle $\phi$ which includes main parabolic reflector 10 disposed confocally with doubly curved hyperbolic subreflector 12 at a common focal point A'. A second focal point A of hyperbolic subreflector 12 is located on a doubly curved focal surface (not shown) on which focal surface is formed a transformed image of the view of the far field of main reflector 10 as indicated hereinbefore. Subreflector 12 is rotatably mounted via mounting means 22 to the axle 23 of a rotational drive means 24 such that subreflector 12 can be selectively rotated about a substantially north-south axis common to focal point A'. Drive means 24 can be activated by control means 25 which can be responsive to control telemetry signals from the surface of celestial body 16 to activate drive means 24 and rotate subreflector 12 by a predetermined amount. It is to be understood that the apparatus and technique for rotating subreflector 12 is merely presented for illustrative purposes only and that other suitable means for rotating subreflector 12 by a predetermined amount about the subtantially north-south axis corresponding to axle 23 as shown in FIG. 2 may be substituted.

Figure 3:
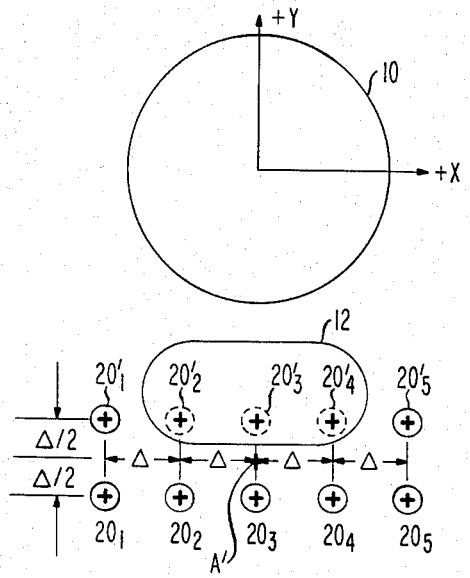
FIG. 3 is a front view of the arrangement of FIG. 2.

As indicated in FIGS. 2 and 3, a plurality of 10 feeds $\mathbf{20}_1$–$\mathbf{20}_5$ and $\mathbf{20}_1'$–$\mathbf{20}_5'$ are disposed on the doubly curved focal surface of the antenna in two rows of five equally spaced feeds each; the spacing between rows is substantially the same as the spacing between feeds. As shown in FIG. 3, the feeds are spaced a distance $\Delta$ from each other parallel to the X axis and also from the corresponding feed in the other row parallel to the Y axis. Additionally, each row is both centered about and disposed a distance $\Delta/2$ along the Y axis from a boresight beam axis 26 of the antenna emanating from focal point A. It is to be understood that such configuration for the feeds is purely for illustration purposes only for the description hereinafter, since feeds would normally be positioned on the image of the associated area either to be illuminated by a beam launched by the feed or received from the associated area by the feed.

Figure 4:
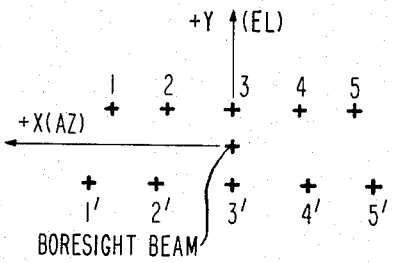
FIG. 4 is a view of the directions of the beams radiated from the main reflector of FIG. 3.
Figure 5:
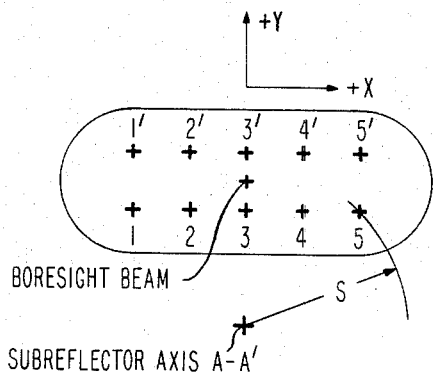
FIG. 5 is a view of the location of the beam centers on the subreflector in the arrangement of FIG. 3.

With the feed arrangement of FIG. 3 and using a subreflector 12 which is doubly curved to introduce barrel distortion to provide the proper transformation of the non-rectangular matrix in the far field to a substantially rectangular matrix on the doubly curved focal surface of the antenna, corresponding beams launched by feeds $\mathbf{20}_1$–$\mathbf{20}_5$ and $\mathbf{20}_1'$–$\mathbf{20}_5'$ will be radiated from main reflector 10 and aimed as shown by points 1–5 and 1'–5', respectively, in FIG. 4. The angular separation of beams is nonuniform because (1) the center of each beam intersects a different point on the subreflector as shown in FIG. 5, and (2) the subreflector magnification, M, decreases as a function of distance, S, for a typical beam intersection point as shown in FIG. 5 due to the doubly curved subreflector configuration. More particularly, as S increases and M decreases, the equivalent focal length of the antenna, $M \times F$, decreases. For a given transverse feed displacement, e.g., $\Delta$ in FIG. 3, the angle between the antenna beams is $\Delta/(M \times F)$ radians. Consequently, the angular spacing of beams 3' and 4' in FIG. 4 is larger than between beams 3 and 4, and also larger than between beams 4' and 5'. Extension of this principle to other beams results in the beam-aiming distribution shown in FIG. 4. This distribution is similar to a pattern of earth longitude and latitude intersections viewed from synchronous orbit on the equatorial arc.

Figure 7:
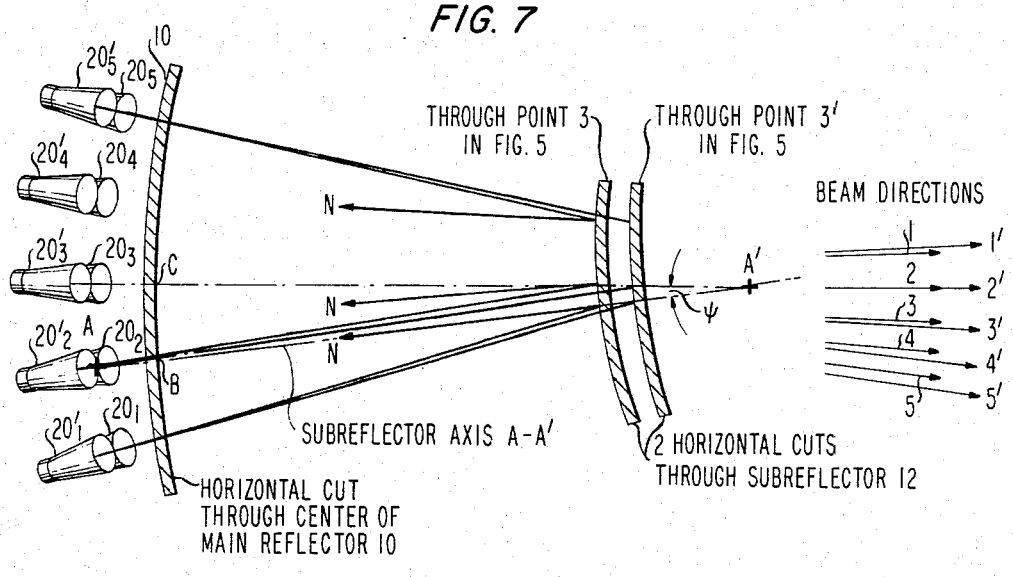
FIG. 7 is a top view of the antenna arrangement illustrating the subreflector as rotated for for beam distribution depicted in FIG. 6.
Figure 6:
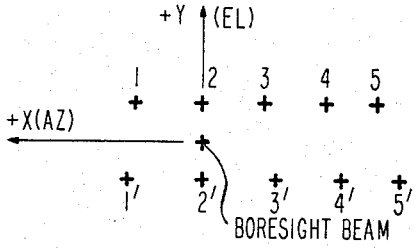
FIG. 6 is a view of the directions of the beams radiated by the main reflector similar to FIG. 4 but from a new equatorial orbit location of the antenna arrangement.

For illustrative purposes, if the satellite incorporating the present antenna is required to be moved to a further-West location on the equatorial arc, then with a properly shaped doubly curved subreflector 12, the same set of latitude and longitude intersections can be obtained by merely rotating subreflector 12 the substantially north-south about axis to obtain the configuration shown in FIG. 6. For the new subreflector orientation, beams 2 and 2' in FIG. 6, rather than beams 3 and 3' as in FIG. 4, are aimed above and below the boresight direction. More particularly, the distribution shown in FIG. 6 can be readily obtained from the configuration shown in FIG. 4 by simply rotating subreflector 12 about the substantially vertical north-south axis which passes through the prime focal point A' by drive means 24 as shown in FIG. 2. For example, in FIG. 7, showing a top view of the antenna after rotation of the subreflector to give the beam configuration shown in FIG. 6, the angle of rotation $\psi$ is chosen such that subreflector 12 axis A—A', which is substantially in the horizontal plane as shown in FIG. 2, passes directly above feed 2 and directly below feed 2'. The feeds themselves are not disturbed and are still arranged as shown in FIGS. 2, 3 and 7.

In FIG. 7, rays from feeds $20_1$–$20_5$ and $20_1'$–$20_5'$ typify those which, after reflection from subreflector 12, intersect the common point C on main reflector 10. After reflection from main reflector 10, such rays define beam azimuth directions as indicated by arrows on the far right of FIG. 7. The corresponding elevation and azimuth directions are similar to those shown in FIG. 6. Amplitude distributions on the main reflector corresponding to the beam directions shown in FIGS. 6 and 7 are not centered on main reflector 10 as they are for the beams shown in FIGS. 2 and 3. Instead, for example, the new amplitude distributions for beams 2 and 2' are offset horizontally on main reflector 10 to a region located above feed horns 2 and 2', i.e., as indicated in FIG. 7 by letter B. The effect of such offset on beamwidths and sidelobes is expected to be minimal. Rays extending from feeds $20_1$, $20_1'$, $20_2$, $20_2'$, $20_5$ and $20_5'$ in FIG. 7 are not necessarily the central ray of each associated beam, but are typical rays used to determine the directions of the radiated beams as shown on the far right of FIG. 7.

Actually, lines defined by points 1–5 and 1'–5' in FIGS. 4 and 6 are not completely horizontal, but are somewhat concave downward. Similarly, nearly vertical lines defined by prime and unprimed corresponding integers in FIGS. 4 and 6 are not straight, but are somewhat concave toward the Y axis. That is, the beam-aiming patterns in FIGS. 4 and 6 are characterized by the optical aberration called barrel distortion.

By proper choice of (a) on-axis subreflector 12 magnification [L/L' in FIG. 2], (b) distance between subreflector 12 focal points [A—A' in FIG. 2], (c) offset angle of main reflector 10 [$\phi$ in FIG. 2], and (d) inclination of subreflector axis [about point A' in FIG. 2], the coefficient of barrel distortion can be optimized for a given celestial body 16 region viewed from synchronous orbit. That is, antenna barrel distortion can be chosen such that beams originating at rows and columns of uniformly spaced feeds are aimed at lines of constant latitude and longitude, respectively. For example, if a satellite is located above the center longitude of the United States, then latitude lines across the U.S. appear concave downward, the center longitude appears as a straight (north-south) line, and other longitudes appear concave toward the north-south line, i.e., the pattern is characterized by barrel distortion, as in FIG. 4. Consequently, the beam-aiming pattern shown in FIG. 4 can be made to agree closely with that formed by U.S. latitudes and longitudes.

Once close agreement is reached, latitudes and longitudes viewed from different orbit locations can be tracked with good accuracy by rotation of subreflector 12 about the substantially north-south axis passing through the main reflector focus. Similar results can be achieved for beams aimed at the unique latitudes and longitudes of major United States cities. Feeds for major-city beams do not necessarily coincide with those shown in FIGS. 2 and 7. However, such feeds can be located on the doubly curved focal surface outlined by the locations of feeds $20_1$–$20_5$ and $20_1'$–$20_5'$. An important practical advantage of this beam re-aiming technique is that the feeds and feed networks are unchanged. That is, electronic reconfiguration or repositioning of feeds is not required.

The reflecting surface of subreflector 12 can be determined using known optical ray tracing techniques to introduce the required barrel distortion, which is a well known optical aberration as defined, for example, at page 152 of the book *Fundamentals of Optics* by F. A. Jenkins and H. E. White, Third Edition, 1957, published by McGraw-Hill Book Company, Inc. By considering the image of the three-dimensional spherical matrix in the far field of the antenna which is formed on the antenna's doubly curved focal surface from a particular orbit location, which view may be only an offset section of such matrix as, for example, only the United States as a portion of the entire Earth, along with the location of subreflector 12 with respect to main reflector 10 and the angles of incidence and reflection, ray tracing techniques can be used to provide a subreflector configuration which can transform the three-dimensional spherical matrix in the far field into a substantially rectangular matrix on the doubly curved focal surface of the antenna.

It is to be understood that the above-described embodiments are simply illustrative of the principles of the invention. Various other modifications and changes may be made by those skilled in the art which will embody the principles of the invention and fall within the spirit and scope thereof. For example, the present invention could be also used with a Gregorian type antenna to introduce distortions. Additionally, distortion could be introduced by subreflector 12 to accommodate various far field three-dimensional matrices found in satellite or terrestrial radio systems.

What is claimed is:

1. A multibeam antenna arrangement comprising:

a main focusing reflector comprising a predetermined sized reflecting surface and far field of view;

a subreflector disposed confocally with the main reflector along a feed axis of the antenna arrangement, the subreflector being curved in orthogonal directions by separate predetermined amounts for transforming a predetermined three-dimensional non-rectangular matrix in the far field of view of the main reflector into a substantially rectangular matrix image of the far field of view on a focal surface of the antenna arrangement; and a plurality of feeds disposed at predetermined separate locations on the substantially rectangular matrix image of the far-field of view on the focal surface of the antenna arrangement and aimed at the subreflector.

2. A multibeam antenna arrangement according to claim 1, wherein the main focusing reflector comprises a parabolic reflecting surface; and the subreflector comprises a doubly curved hyperbolic reflecting surface.

3. A multibeam antenna arrangement according to claim 2, wherein each of the plurality of feeds is aimed towards the subreflector such that a central ray of a beam launched by each of the feeds impinges a common point on the reflecting surface of the main reflector; and the subreflector is capable of being selectively rotated by a predetermined amount about an axis which is substantially parallel with an associated axis of the three-dimensional, nonrectangular, matrix and which passes through a confocal point of the main reflector and subreflector for repositioning beams from the plurality of feeds to their original area in the far field of view when the antenna arrangement is repositioned to a second predetermined location about said predetermined axis in the far-field of view.

4. A multibeam antenna arrangement according to claim 1 wherein the main focusing reflector comprises a parabolic reflecting surface; and the subreflector comprises a doubly curved ellipsoidal reflecting surface.

5. A multibeam antenna arrangement according to claim 1 or 4 wherein each of the plurality of feeds is aimed towards the subreflector such that a central ray of a beam launched by each of the feeds impinges a common point on the reflecting surface of the main reflector.

* * * * *